US010035277B2

(12) United States Patent
Lipscomb et al.

(10) Patent No.: US 10,035,277 B2
(45) Date of Patent: Jul. 31, 2018

(54) APPARATUS AND SYSTEM FOR CUTTING A PATTERN IN A SHEET MATERIAL

(71) Applicant: Fiskars Brands, Inc., Madison, WI (US)

(72) Inventors: Daniel J. Lipscomb, Prairie Du Sac, WI (US); Douglas R. Nelson, Madison, WI (US); Stephen P. Dechant, Lodi, WI (US)

(73) Assignee: Fiskars Brands, Inc., Middleton, WI (US)

( * ) Notice: Subject to any disclaimer, the term of this patent is extended or adjusted under 35 U.S.C. 154(b) by 198 days.

(21) Appl. No.: 14/951,778

(22) Filed: Nov. 25, 2015

(65) Prior Publication Data

US 2016/0339592 A1 Nov. 24, 2016

Related U.S. Application Data

(63) Continuation-in-part of application No. 29/527,353, filed on May 18, 2015, now Pat. No. Des. 768,711, and a continuation-in-part of application No. 29/528,575, filed on May 29, 2015, now Pat. No. Des. 763,055.

(51) Int. Cl.

| | |
|---|---|
| ***B26B 25/00*** | (2006.01) |
| ***B26B 5/00*** | (2006.01) |
| ***B26B 29/06*** | (2006.01) |

(52) U.S. Cl.

CPC ..... *B26B 25/005* (2013.01); *B26B 5/003* (2013.01); *B26B 29/06* (2013.01)

(58) Field of Classification Search

CPC ..... B26B 25/005; B26B 25/007; B26B 29/06

USPC ..... 30/292, 306, 307, 319; D7/694; D8/98

See application file for complete search history.

(56) References Cited

U.S. PATENT DOCUMENTS

| | | | | |
|---|---|---|---|---|
| 121,198 A * | 11/1871 | Robinson | B26B 25/00 30/319 |
| 124,114 A * | 2/1872 | Bright | B26B 25/00 30/292 |
| 142,584 A * | 9/1873 | Rice | B26B 25/00 30/292 |
| 312,043 A * | 2/1885 | Van Horn | B26B 25/00 30/292 |

(Continued)

FOREIGN PATENT DOCUMENTS

| | | | |
|---|---|---|---|
| DE | 3232161 C1 * | 3/1984 | B26B 29/02 |
| FR | 2636000 B1 * | 8/1994 | B26B 25/005 |

*Primary Examiner* — Jason Daniel Prone

(74) *Attorney, Agent, or Firm* — Foley & Lardner LLP

(57) ABSTRACT

An apparatus for cutting a pattern in a sheet material includes a template having a channel with a predetermined shape. The apparatus also includes a cutting device, including a base having one or more projections configured to interact with the channel, a handle coupled to the base and moveable relative to the base between a first position and a second position, and a retractable rotary blade coupled to the handle. The retractable rotary blade is moveable between a refracted position when the handle is in the first position, and an extended position when the handle is in the second position. The retractable rotary blade is configured to cut a pattern according to the predetermined shape of the channel when the cutting device is tracked along the channel while both the handle is in the second position and the one or more projections are positioned within the channel.

22 Claims, 8 Drawing Sheets

(56) References Cited

U.S. PATENT DOCUMENTS 387,621 A * 8/1888 Clarke ..... B26B 25/00 30/292
389,529 A * 9/1888 Ridgely ..... B26B 25/00 30/292
389,901 A * 9/1888 Robinson et al. ..... B26B 25/00 30/292
406,821 A * 7/1889 Cunningham ..... B26B 25/00 30/319
423,855 A * 3/1890 Clarke et al. ..... B26B 25/00 30/292
463,838 A * 11/1891 Johnson ..... B26B 25/00 30/292
609,213 A * 8/1898 Ridgely ..... B26B 25/00 30/292
612,120 A * 10/1898 Pierce ..... B26B 25/00 30/292
621,299 A * 3/1899 Empfield ..... B26D 7/025 30/292
659,983 A * 10/1900 Nicholson ..... B26B 25/00 30/319
683,538 A * 10/1901 Willcox et al. ..... B26F 1/382 30/292
704,352 A * 7/1902 Mathein ..... B26B 25/00 30/319
728,843 A * 5/1903 Borden ..... B26B 25/00 30/292
733,511 A * 7/1903 Ridgely ..... B26B 25/00 30/292
745,515 A * 12/1903 Perks ..... B26B 25/00 30/292
745,516 A * 12/1903 Perks ..... B27G 19/02 30/292
745,517 A * 12/1903 Perks ..... B26B 25/00 30/292
752,842 A * 2/1904 Keeling ..... B27B 5/184 30/292
775,434 A * 11/1904 Williams ..... B26B 25/00 30/292
791,793 A * 6/1905 Johnson ..... B26B 25/00 30/292
794,013 A * 7/1905 Hill ..... B26B 25/00 30/292
802,720 A * 10/1905 Weber ..... B26B 25/00 30/292
802,721 A * 10/1905 Weber ..... B26B 25/00 30/292
804,520 A * 11/1905 Colthar ..... B27G 19/02 30/292
821,681 A * 5/1906 Vandermark ..... B26B 25/00 30/292
862,028 A * 7/1907 Smith ..... B26B 25/00 30/292
908,499 A * 1/1909 Ridgely ..... B26D 1/185 30/292
908,540 A * 1/1909 Ridgely ..... B27G 19/02 30/292
909,227 A * 1/1909 Breckenridge ..... B26D 1/185 30/292
915,818 A * 3/1909 Baldwin ..... C03B 33/12 30/319
957,409 A * 5/1910 Brening ..... B26D 1/185 30/292
1,020,364 A * 3/1912 Naylor ..... B26B 25/00 30/292
1,534,576 A * 4/1925 Edgren ..... B44C 7/025 30/292
1,578,477 A * 3/1926 Smith et al. ..... B26D 3/08 30/292
1,604,232 A 10/1926 Lipke
1,828,621 A * 10/1931 Roberts ..... E04D 15/04 30/319
1,870,585 A * 8/1932 Parks et al. ..... C03B 33/12 30/319
1,983,778 A * 12/1934 Rosenquist ..... B44C 7/025 30/292
2,014,190 A 9/1935 Simon
2,041,240 A * 5/1936 Gluesing ..... B26B 25/005 30/292
D141,882 S 7/1945 Matson
2,449,702 A * 9/1948 Iwerks ..... G03B 15/08 33/25.3
2,478,071 A 8/1949 Agrillo
2,500,873 A 3/1950 Sager
D167,043 S 6/1952 Kintz
2,777,626 A 1/1957 French
3,037,293 A 6/1962 Yost
3,180,380 A * 4/1965 Franzen ..... B23B 51/05 30/310
D209,420 S * 11/1967 Snyder ..... D8/98
3,456,346 A * 7/1969 Snyder ..... B26B 3/08 30/310
3,526,038 A * 9/1970 Katz ..... G09B 29/004 30/292
3,576,148 A * 4/1971 Katz ..... B26B 29/06 30/292
3,581,970 A 6/1971 Colato
3,768,347 A * 10/1973 Wade ..... B26D 3/10 83/565
4,083,453 A 4/1978 Berger et al.
4,176,452 A * 12/1979 Duggins ..... B26B 5/005 30/293
4,233,736 A * 11/1980 Duggins ..... B26F 1/3853 30/293
4,247,148 A * 1/1981 Eriksson ..... E01C 23/092 30/292
D279,797 S 7/1985 Brunetto
D282,671 S 2/1986 Papsdorf
4,593,467 A * 6/1986 Safar ..... B23B 51/05 30/310
4,601,103 A * 7/1986 Sugiyama ..... B26B 25/005 30/292
4,782,730 A * 11/1988 Picone ..... B23B 51/05 30/310
5,079,843 A * 1/1992 Shelton ..... A61B 17/32053 30/310
D332,734 S 1/1993 Fushiya et al.
5,233,748 A * 8/1993 Logan ..... B26B 5/005 30/293
5,511,316 A 4/1996 Fischer et al.
5,555,631 A * 9/1996 Houston ..... B43L 11/055 33/27.032
5,557,996 A * 9/1996 Reber ..... B25H 7/02 30/292
D375,435 S * 11/1996 Knapp ..... D7/694
5,579,670 A * 12/1996 McCormick ..... A41H 31/00 83/56
D389,326 S 1/1998 Moore
5,823,086 A * 10/1998 McCormick ..... A41H 31/00 83/565
5,860,217 A * 1/1999 Braun ..... B26B 29/06 30/310
D422,188 S * 4/2000 Lira-Nunez ..... D8/98
6,052,909 A 4/2000 Gardner
6,082,008 A 7/2000 Lariviere, Jr.
6,158,133 A 12/2000 Carlson et al.
6,216,354 B1 4/2001 Carbone
6,216,577 B1 4/2001 Lira-Nunez et al.
6,282,742 B1 9/2001 Boggs
D448,801 S 10/2001 Lariviere et al.
D449,338 S 10/2001 Lariviere et al.
6,321,457 B1 11/2001 Lariviere et al.
6,374,503 B1 4/2002 Carlson et al.
6,438,850 B2 * 8/2002 Young ..... B26B 25/005 30/319
6,484,406 B1 11/2002 Gardner
6,575,068 B2 * 6/2003 Lira-Nunez ..... B26B 5/005 30/294

(56) References Cited

U.S. PATENT DOCUMENTS 6,612,035 B2 * 9/2003 Brown ..... B26B 29/06 30/292
6,643,936 B2 * 11/2003 Carlson ..... B26B 25/005 30/292
6,668,461 B2 12/2003 Gardner
6,675,689 B2 * 1/2004 Nunez ..... B26B 25/007 30/319
6,708,413 B2 3/2004 Carlson et al.
6,722,051 B2 * 4/2004 Carlson ..... B26B 29/06 30/293
6,813,839 B2 * 11/2004 McLean ..... B26B 29/06 30/293
D499,325 S 12/2004 McLean et al.
6,862,812 B2 * 3/2005 Muhlebach ..... B26B 3/08 30/319
6,877,243 B2 * 4/2005 Carlson ..... B26B 29/06 30/293
6,951,058 B2 * 10/2005 McLean ..... B26B 29/06 30/293
D512,567 S 12/2005 Eckhardt
7,010,860 B2 3/2006 Gardner et al.
D519,562 S 4/2006 Phillips et al.
7,150,108 B2 12/2006 Babb
D566,512 S 4/2008 Chie
7,458,300 B2 * 12/2008 Williams ..... A61J 7/0007 83/13
D589,776 S 4/2009 Camp
D594,308 S * 6/2009 Davies ..... D8/98
8,006,843 B1 8/2011 McFarland
D653,521 S 2/2012 Wike
8,166,859 B2 * 5/2012 Angevine ..... B26B 29/06 83/565
8,826,789 B2 * 9/2014 Bagley ..... B26B 29/06 30/292
D750,453 S * 3/2016 Popov ..... D7/694
D763,055 S * 8/2016 Lipscomb ..... D8/98
2004/0187318 A1 * 9/2004 Mathieu ..... B26B 25/005 30/319
2007/0028463 A1 * 2/2007 Chan ..... B26D 1/205 30/319
2007/0186745 A1 * 8/2007 Loibl ..... B26B 25/005 83/565
2009/0145278 A1 6/2009 Angevine
2009/0151171 A1 * 6/2009 Chen Lin ..... B26B 29/06 30/275.4
2009/0151531 A1 * 6/2009 Levin ..... B26B 29/06 83/565
2010/0101098 A1 * 4/2010 Hsu ..... B26B 25/007 30/319
2011/0192265 A1 * 8/2011 Yoder ..... B26B 29/06 83/522.19
2012/0042762 A1 * 2/2012 Umholtz ..... B26B 25/005 83/452
2015/0107121 A1 * 4/2015 Koontz ..... B26B 25/005 30/319

* cited by examiner

APPARATUS AND SYSTEM FOR CUTTING A PATTERN IN A SHEET MATERIAL

CROSS-REFERENCE TO RELATED APPLICATIONS

This application is a continuation-in-part of U.S. application Ser. No. 29/527,353, filed May 18, 2015, and is also a continuation-in-part of U.S. application Ser. No. 29/528,575, filed May 29, 2015, both of which are incorporated herein by reference in their entireties.

TECHNICAL FIELD

The present application relates generally to the field of cutting devices for cutting patterns in sheet material.

BACKGROUND

Cutting devices may be used to cut a desired shape in sheet material. However, it may be difficult to consistently cut the desired shape with scissors or another similar hand-held tool. A rotary blade and a template may also be used, but the rotary blade may be difficult to maneuver within the desired pattern. A user may be required to adjust the rotary blade at least once before the cut is completed due to the desired shape. The rotary blade may also wander into the template as the cut is performed, damaging the template and/or the blade itself.

SUMMARY

One embodiment relates to an apparatus for cutting a pattern in a sheet material. The apparatus includes a template comprising a channel having a predetermined shape, and a cutting device. The cutting device includes a base having one or more projections configured to interact with the channel, a handle coupled to the base and moveable relative to the base between a first position and a second position, and a retractable rotary blade coupled to the handle, the retractable rotary blade moveable between a retracted position when the handle is in the first position and an extended position from the base in line with the one or more projections when the handle is in the second position, the retractable rotary blade configured to cut a pattern according to the predetermined shape when the cutting device is tracked along the channel while both the handle is in the second position and the one or more projections are positioned within the channel.

Another embodiment relates to an apparatus for cutting a pattern in a sheet material. The apparatus includes a template comprising a channel having a predetermined shape, and a cutting device. The cutting device includes a base having one or more projections configured to interact with the channel, a handle coupled to the base, the handle rotatable relative to the base about a vertical axis provided by the base, the handle moveable along the vertical axis relative to the base between a first position and a second position, and a removable blade cartridge coupled to the handle, the blade cartridge including a rotary blade moveable with the blade cartridge between a retracted position when the handle is in the first position and an extended position from the base in line with the one or more projections when the handle is in the second position, the rotary blade configured to cut a pattern according to the predetermined shape when the cutting device is tracked along the channel while both the handle is in the second position and the one or more projections are positioned within the channel.

Yet another embodiment relates to an apparatus for cutting a pattern in a sheet material. The apparatus includes a template, including a bottom surface, a channel formed through the template and having a predetermined shape, and a stop coupled to the bottom surface, the stop raised relative to the bottom surface and configured to align a sheet of material to be cut. The apparatus also includes a cutting device, including a base having one or more projections configured to interact with the channel, a handle coupled to the base, the handle rotatable relative to the base about a vertical axis provided by the base, the handle moveable along the vertical axis relative to the base between a first position and a second position, and a retractable rotary blade coupled to the handle, the retractable rotary blade moveable between a retracted position when the handle is in the first position and an extended position from the base in line with the one or more projections when the handle is in the second position, the retractable rotary blade configured to cut a pattern according to the predetermined shape when the cutting device is tracked along the channel while the handle is in the second position and the one or more projections are positioned within the channel.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the Figures, an apparatus for cutting a circular pattern in a sheet material and components thereof are shown according to an exemplary embodiment.

Figure 1:
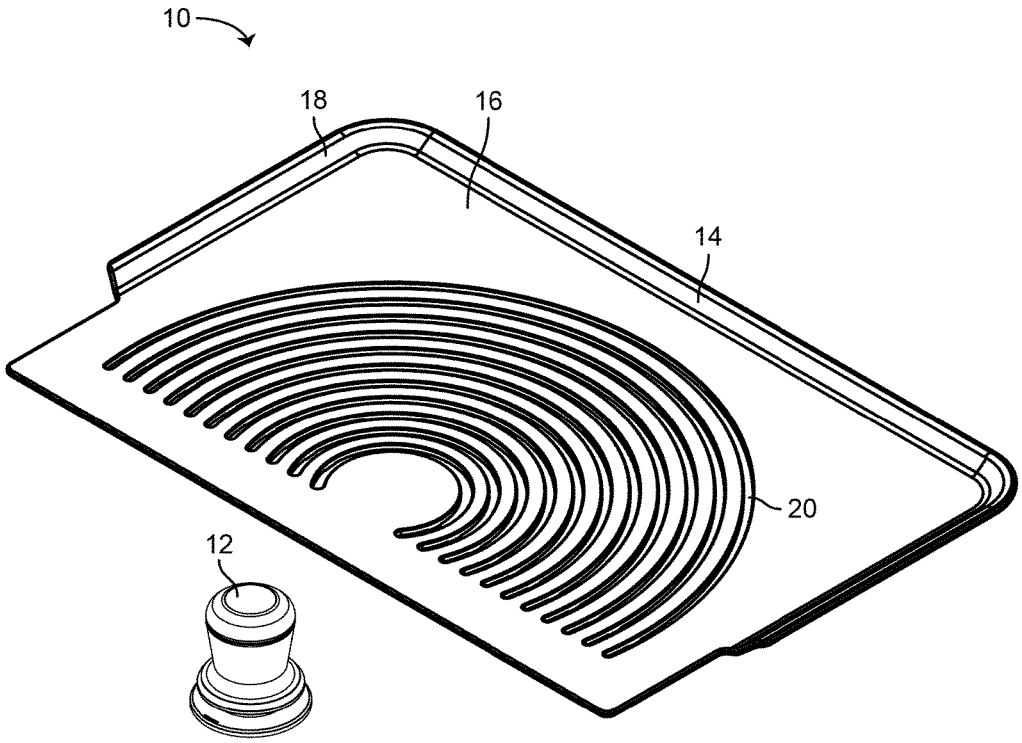
FIG. 1 is a top perspective view of an apparatus for cutting a pattern in a sheet material, the apparatus including a cutting device and a cutting template, in accordance with an exemplary embodiment.
Figure 2:
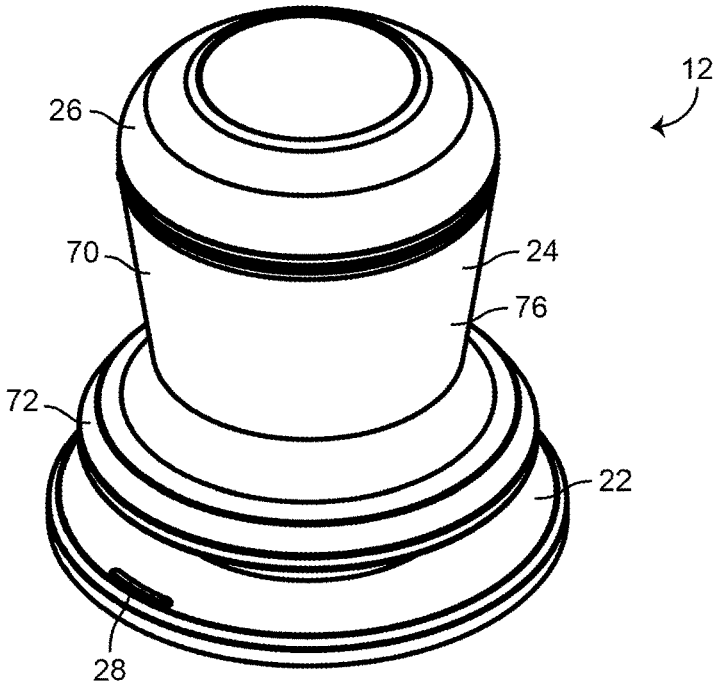
FIG. 2 is a top perspective view of a cutting device for the cutting apparatus of FIG. 1, the cutting device having a retractable blade shown in the retracted position, in accordance with an exemplary embodiment.
Figure 3:
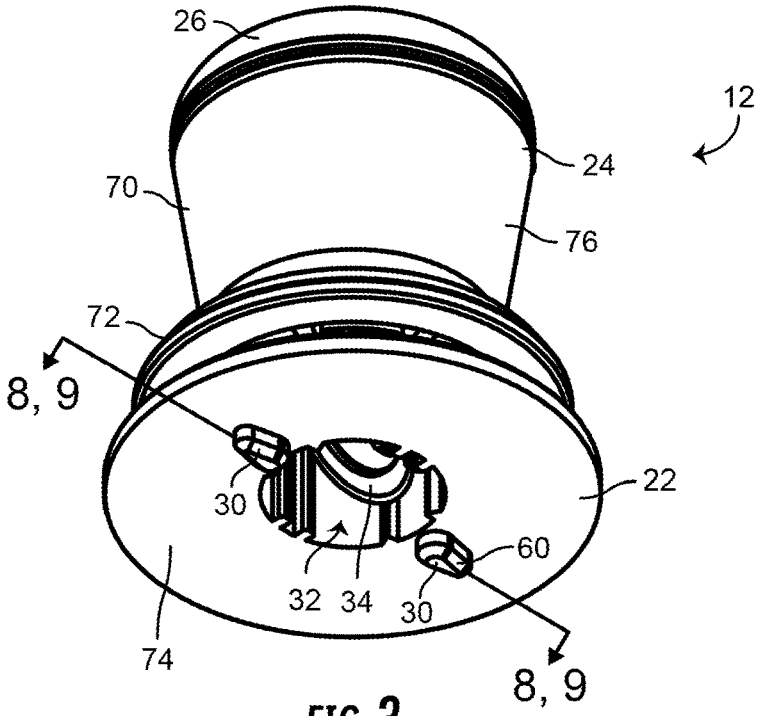
FIG. 3 is a bottom perspective view of the cutting device of FIG. 2 with the retractable blade in the retracted position.

Referring to FIG. 1, a cutting apparatus 10 is shown according to an exemplary embodiment. The apparatus 10 shown in FIG. 1 is configured to facilitate making circular cuts in a sheet of material (e.g., a sheet of fabric). However, in other embodiments the apparatus 10 may be configured to cut another desired (i.e., non-circular) shape in a sheet of material, including other symmetrical shapes such as an oval, hexagon, rectangle, triangle, and the like. The apparatus 10 includes a cutting device 12 (e.g., carriage, cutting tool, etc.) and a cutting template 14 (e.g., board). The cutting template 14 includes a flat top surface 16, a raised outer edge 18 bordering rear and side portions of the top surface 16, and a plurality of channels 20 (e.g., grooves, guides, etc.) formed in the top surface 16 and through the template 14. Each of the channels 20 is configured to receive the cutting device 12. The channels 20 are configured to guide the cutting device 12 around the circumference of the channel's 20 predetermined radius to make a circular cut. For instance, a material to be cut may be folded in half and placed underneath the template 14. The cutting device 12 may then be placed into one of the channels 20. The selected channel 20 is configured to guide the movement of the cutting device 12 from one end of the channel 20 to the other. The movement of the cutting device 12 causes a semi-circular cut through both halves of the sheet material when a blade 34 (shown in FIG. 3) of the device 12 is extended, causing a wholly circular pattern to be cut within the material. In other embodiments in which the apparatus 10 is configured to cut a non-circular shape in the sheet of material, the channels 20 may be configured (e.g., shaped) accordingly.

Referring to FIGS. 2-7, the cutting device 12 of the apparatus 10 is shown according to an exemplary embodiment. The cutting device 12 is configured to move between a first position (i.e., a retracted position) in which the blade 34 (e.g., rotary blade) is retracted within the device 12 (shown in FIGS. 2-4), and a second position (i.e., a cutting, extended, or exposed position) in which the blade 34 is projected from the device 12 to make a cut (shown in FIGS. 5-7). The cutting device 12 includes a base 22, a handle 24 rotatably coupled to the base 22, and a blade cartridge 36 housing the blade 34. The handle 24 is configured to be manipulated (e.g., held, received, operated, moved, etc.) by an operator of the apparatus 10, including to move the device 12 within the channel 20 when the cutting device 12 is in the second position. The handle 24 is freely rotatable relative to the base 22 and about a vertical axis (i.e., a longitudinal axis) provided by the base 22 (shown in FIG. 8), including as a cut is being performed within one of the channels 20. The rotatable handle 24 allows a user of the apparatus 10 to maintain a comfortable hand position and/or grip on the handle 24 as the user tracks the device 12 within the channels 20 in the template 14.

Referring still generally to FIGS. 2-7, the handle 24 includes a body 70 having a skirt 76 and a flange 72. The body 70, including the skirt 76 and the flange 72, may be a single piece. The body 70 has an annular shape, having an opening formed therethrough that is configured to receive at least a portion of the base 22 (see FIG. 8). The handle 24 also includes a cap 26 removably coupled to and covering an open top end of the body 70. For instance, the cap 26 and a portion of the body 70 may each include corresponding threads configured to mate the cap 26 with the body 70. The handle 24 is sized and shaped to enable a user of the apparatus 10 to grip the handle 24 while tracking the device 12 within the channels 20 of the template 14 when the device 12 is in the second position. The skirt 76, for instance, has a smaller maximum diameter than the cap 26 or the flange 72, enabling a user to grip the handle 24 more easily at the skirt 76. The skirt 76 is V-shaped, decreasing in diameter from a top end of the skirt 76 (i.e., at or near the cap 26) to the lower end of the skirt 76 (i.e., at the flange 72).

Figure 5:
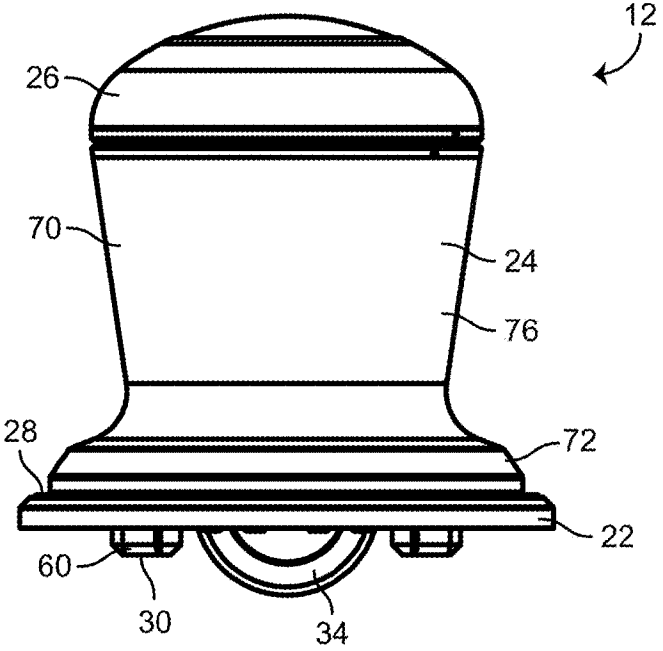
FIG. 5 is a front plan view of the cutting device of FIG. 2 with the retractable blade in the extended position.
Figure 4:
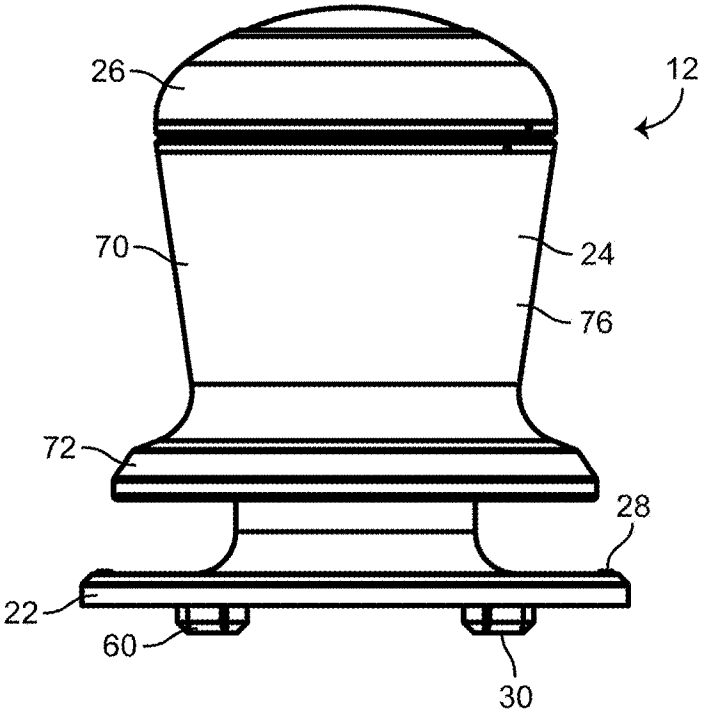
FIG. 4 is a front plan view of the cutting device of FIG. 2 with the retractable blade in the retracted position.
Figure 6:
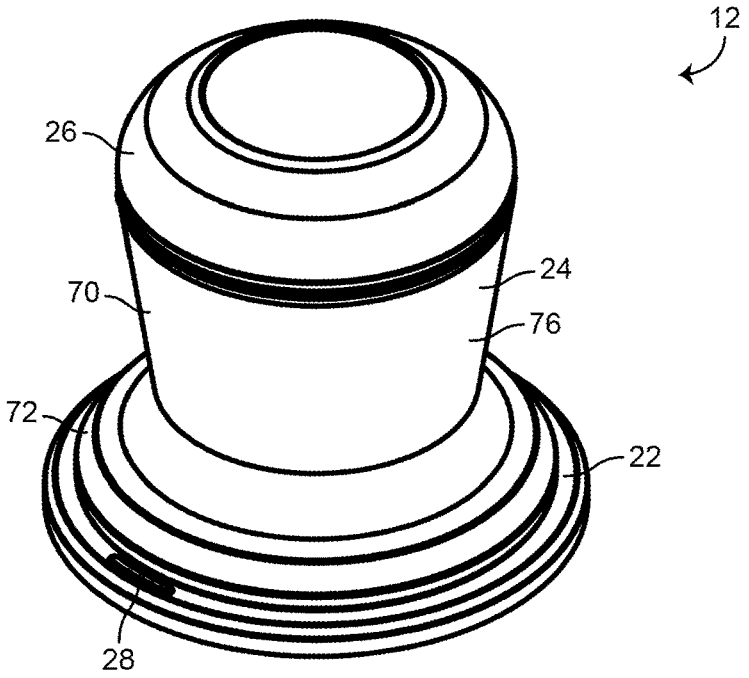
FIG. 6 is a top perspective view of the cutting device of FIG. 2 with the retractable blade in the extended position.
Figure 7:
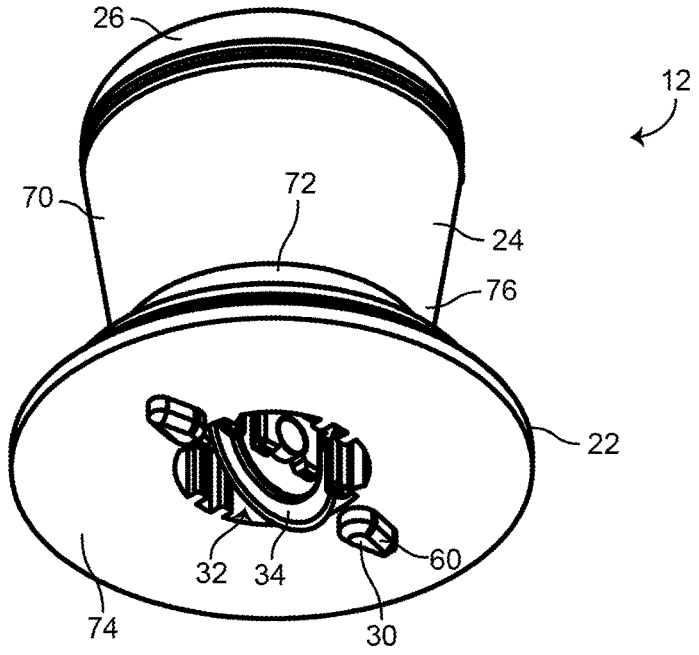
FIG. 7 is a bottom perspective view of the cutting device of FIG. 2 with the retractable blade in the extended position.

In addition to being rotatable, the handle 24 is configured to move axially relative to the base 22, along the vertical axis provided by the base 22. When a downward (e.g., compressive) force is applied to the handle 24 while the device 12 is in the first position (shown in FIG. 4), the blade 34 of the cutting device 12 is moved from the retracted position to the cutting position (as shown in FIG. 5). For instance, a manual force may be applied by the user at the cap 26. Downward movement of the handle 24 forces the blade cartridge 36 downward in the same direction as the handle 24, causing the blade 34 of the blade cartridge 36 to extend to the cutting position (as shown in FIGS. 5 and 7). When the blade 34 is extended, the cutting device 12 may be used to cut a desired pattern within a sheet of material. The handle 24 is spring-loaded to return the device 12 (e.g., the blade 34) to the first position when the force is removed.

Still referring generally to FIGS. 2-7, the base 22 has an annular disc shape, having an opening 32 formed through the center of the base 22 to allow the blade 34 to extend out from the base 22 to make a cut. The base 22 includes projections 30 (e.g., guides) configured to interface with the channels 20 of the template 14, guiding movement of the cutting device 12 within the channels 20 when the cutting device 12 is in the cutting position. The projections 30 are intended to guide the blade 34 within the channels 20, being positioned in line with the cutting path of the rotary blade 34. The projections 30 may have a width approximately equal to the width of the channels 20 to prevent the blade 34 from wandering into the sides of the channels 20. By aligning (e.g., centering) the blade 34 within the channels 20, the projections 30 may prevent damage to the template 14 and/or the blade 34. The projections 30 include chamfers 60 in the illustrated embodiment. The chamfers 60 are intended to interface with complementary features of the channels 20 to align the projections 30 (i.e., the cutting device 12) within the channels 20. The chamfers 60 may aid in aligning (e.g., centering) the blade 34 within the corresponding channel 20 when the blade 34 is in the extended position within the channel 20. In other embodiments, the projections 30 and the channels 20 may have other complementary shapes configured to align the projections 30 (and the blade 34) within the channels 20. The base 22 also includes a flat bottom surface 74 configured to interface with the top surface 16 of the template 14 when the projections 30 are positioned within one of the channels 20. Tabs 28 are positioned opposite each other on a top side of the base 22. The tabs 28 are intended to assist the user in moving the cutting device 12 within the channels 20 by providing an indication of the direction of the blade 34 when the blade 34 is not visible (e.g., is positioned within one of the channels 20).

Figure 8:
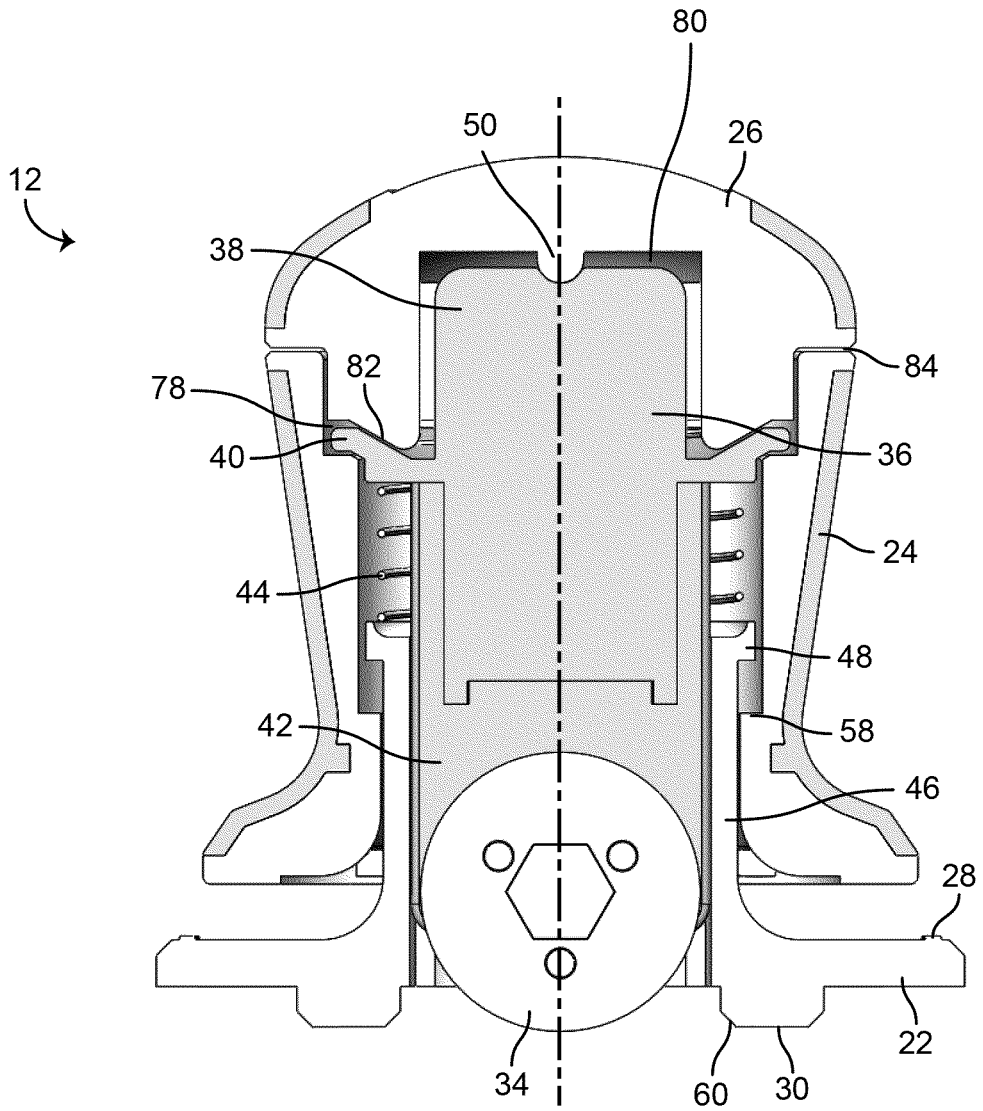
FIG. 8 is a cross-sectional view of the cutting device of FIG. 3 in an upright position, taken along line 8-8.
Figure 9:
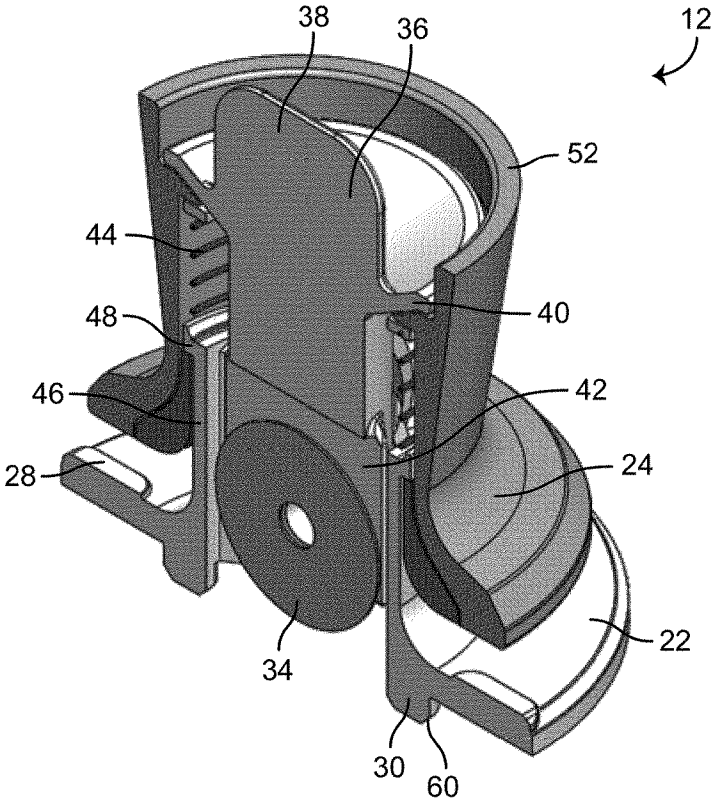
FIG. 9 is a perspective cross-sectional view of the cutting device of FIG. 3, taken along line 9-9.

Referring now to FIGS. 8 and 9, the cutting device 12 is shown in further detail and according to an exemplary embodiment. FIG. 8 shows a cross-sectional view of the cutting device 12 when the cutting device 12 is between the first and second positions (i.e., with the blade 34 partially extended). FIG. 9 shows a cross-sectional view of the cutting device in the first position, but with the cap 26 removed. The blade cartridge 36 is positioned within the cutting device 12. In an exemplary embodiment, the blade cartridge 36 is a single unit configured to be removed and replaced when the blade 34 requires replacement. The blade cartridge 36 provides a case for the blade 34 so that a user of the cutting device 12 may remove the blade 34 without touching the blade 34. The blade cartridge 36 includes a tab 38 having an annular flange 40, as well as a housing 42 configured to store the blade 34. When the cutting device 12 is in the first (i.e., resting) position (as shown in FIG. 9), the tab 38 extends vertically above the body 70 into an area that is typically covered by the cap 26. The cap 26 includes a pocket 80 that is sized and shaped to accommodate the tab 38 when the cap 26 is coupled to the body 70 (as shown in FIG. 8). The tab 38 is configured to be grasped by a user of the cutting device 12 to remove and replace the blade cartridge 36, and thus the blade 34. For instance, the cap 26 may be removed (as shown in FIG. 9) to reveal the tab 38. In an exemplary embodiment, the tab 38 is positioned parallel to and on the same two-dimensional plane as the rotary blade 34.

Still referring to FIGS. 8 and 9, the base 22 includes a skirt 46 configured to receive the blade cartridge 36. The cutting device 12 includes a spring 44 or other form of biasing member positioned between the flange 40 of the blade cartridge 36 and the skirt 46. The spring 44 is configured to push against both the flange 40 and the skirt 46, driving apart the blade cartridge 36 and the base 22 (i.e., the skirt 46) in absence of an oppositional force (i.e., a force applied by a user of the device 12 to cut). The spring 44 is configured to return the device 12 to the first (i.e., retracted) position after the cut has been made. The flange 40 is captured within a pocket 78 formed by the body 70 and the cap 26, such that the body 70 and the cap 26 (i.e., the handle 24) are also driven upward by the force of the spring 44. The skirt 46 forms an annular outer rib 48 positioned at or near a top end of the skirt 46. An inner surface of the handle 24 includes a shelf 58. The rib 48 is configured to provide a stop for the shelf 58 (i.e., for the handle 24) against the force of the spring 44, preventing the handle 24 and/or the blade cartridge 36 from being de-coupled from the base 22 by the force of the spring 44 by interfacing with the shelf 58 (as shown in FIG. 9).

When a downward force is applied to the handle 24, the blade cartridge 36, and thus the blade 34, are shifted similarly to expose the blade 34. The cap 26 includes a projection 50 configured to engage the tab 38 of the blade cartridge 36 when the handle 24 is depressed. The cap 26 also includes interfaces 82 configured to engage the flange 40, and interfaces 84 configured to engage the body 70, moving the cartridge 36 and the body 70 along with the cap 26. The cap 26 is configured to mate with a lip 52 formed by the body 70.

Figure 10:
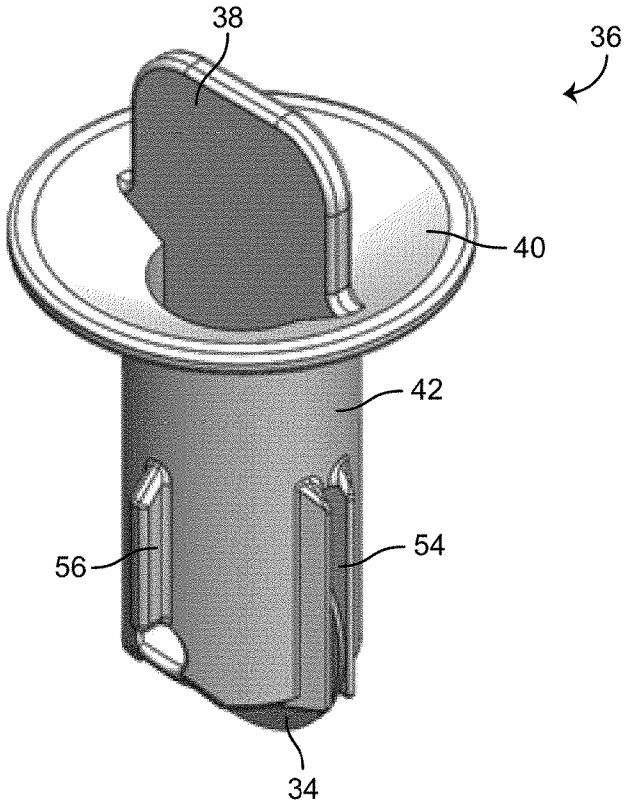
FIG. 10 is a top perspective view of a removable blade cartridge for the cutting device of FIG. 2, in accordance with an exemplary embodiment.

Referring to FIG. 10, the blade cartridge 36 is shown according to an exemplary embodiment. As described previously, the cartridge 36 includes the cylindrical (e.g., annular) housing 42 configured to house the blade 34. The housing 42 includes a track 54 configured to provide a guide for the blade 34, preventing the blade 34 from twisting or moving from side to side. The track 54 may also match with corresponding components of the base 22 to align the blade cartridge 36 relative to the base 22. Similarly, the blade cartridge 36 includes a guide 56 configured to match with a corresponding feature of the base 22 to align the blade cartridge 36 relative to the base 22. In an exemplary embodiment, the blade cartridge 36 is "keyed" (e.g., interlocked, mated, etc.) to the base 22 such that the blade 34 cuts tangent to the circular pattern.

Figure 11:
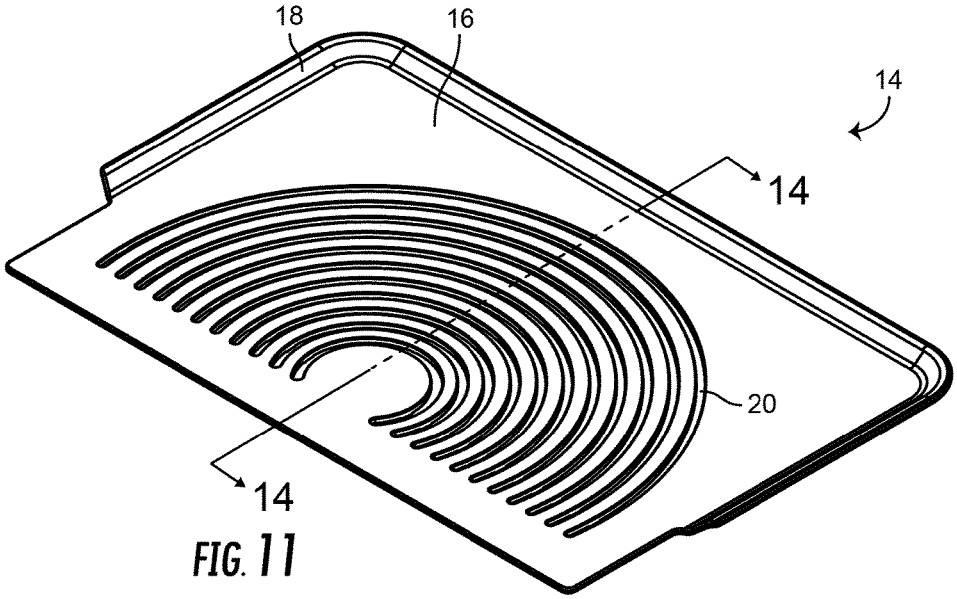
FIG. 11 is a top perspective view of a cutting template for the cutting apparatus of FIG. 1, in accordance with an exemplary embodiment.
Figure 12:
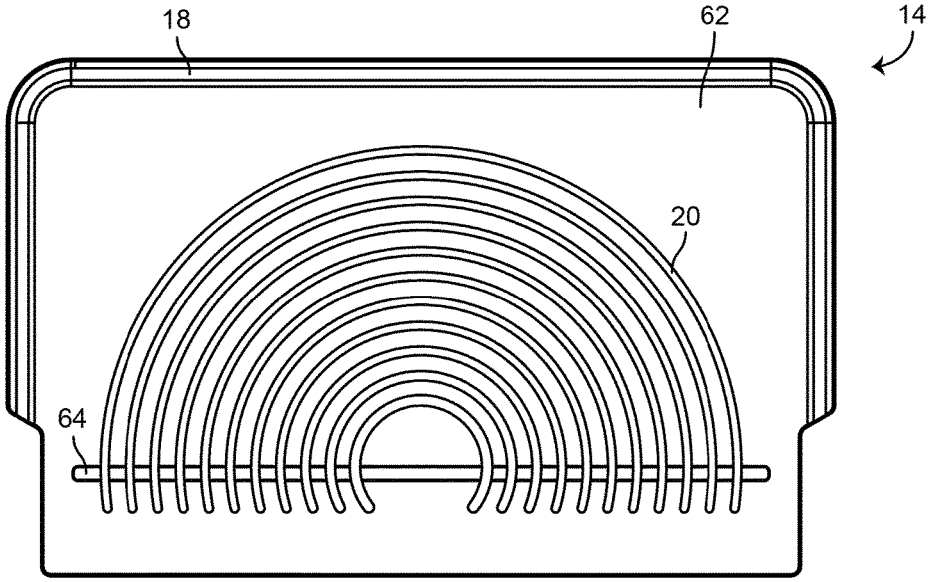
FIG. 12 is a bottom plan view of the template of FIG. 11.

Referring to FIGS. 11-14, the template 14 of the cutting apparatus 10 is shown according to an exemplary embodiment. As shown in FIGS. 11 and 12, the plurality of channels 20 are semi-circular in shape, with each of the plurality of channels 20 providing a different predetermined circular cutting radius. The predetermined cutting radii associated with each of the channels 20 corresponds to the radius of the circular material pattern that will be produced using a selected channel 20. The channels 20 are arranged on the template 14 according to their cutting radius, in ascending order from a front portion of the template 14 to a rear portion of the template 14 (i.e., at or near the rear raised edge 18). In an exemplary embodiment, the cutting radii range from a minimum radius of approximately 5.08 centimeters (2 inches) to a maximum diameter of approximately 15.24 centimeters (6 inches). In other embodiments, the radii of the channels 20 may be larger or smaller, depending on the particular application. In some embodiments, for instance, the template 14 may be manipulatable by an operator of the apparatus 10 to create a custom channel having an operator-determined cutting radius. As noted previously, in other embodiments the apparatus 10 may be configured to cut another desired (i.e., non-circular) shape in a sheet of material. In such embodiments, the channels 20 may be configured according to the desired shape. For instance, in embodiments in which the desired cutting shape is an oval, the channels 20 may each be semi-ovular in shape.

Figure 13:
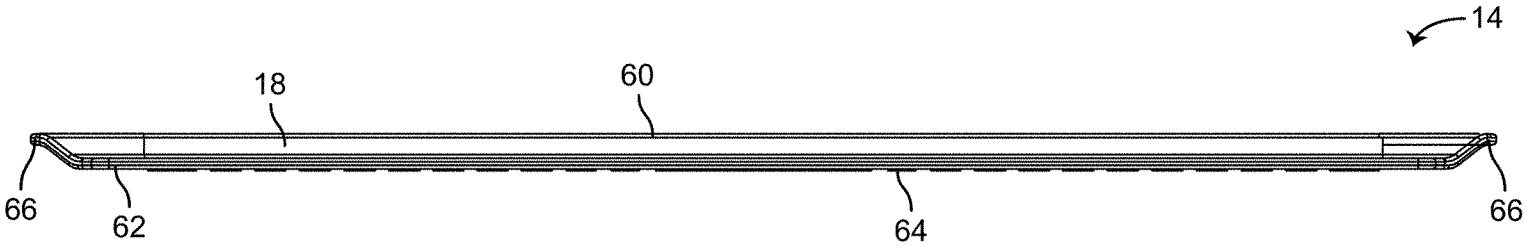
FIG. 13 is a front plan view of the template of FIG. 11.
Figure 14:
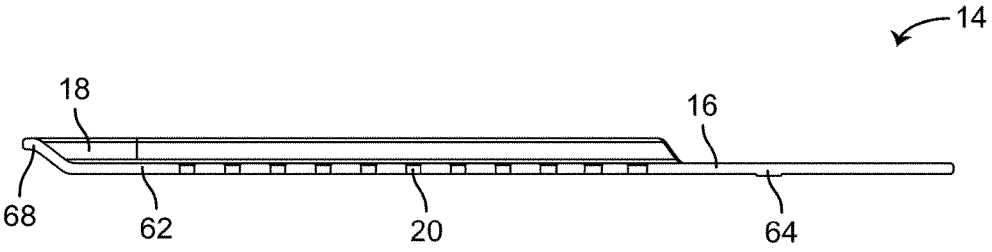
FIG. 14 is a cross-sectional view of the template of FIG. 11, taken along line 14-14.

Referring particularly to FIGS. 12-14, the template 14 includes a stop 64 formed on a bottom surface 62 of the template 14. The stop 64 is formed across a length of the bottom surface 62. The stop 64 is raised relative to the bottom surface 62 in order to provide alignment for a sheet of fabric to be cut by the cutting device 12. The stop 64 extends across the length of the template 14 and across each of the channels 20. However, the channels 20 are continuous and formed entirely through the template 14. Thus, as shown in FIG. 13, the stop 64 may be formed from a plurality of stop strips positioned between each of the channels 20. In an exemplary embodiment, the stop 64 is positioned across the diameter of each of the plurality of channels 20, such that the portion of each of the channels 20 that is positioned above the stop 64 (according to the orientation of FIG. 12) has a semi-circular shape. Thus, if a sheet of material is folded in half and the material's fold line is aligned with the stop 64, the cutting device 12 is configured to make a circular shape within the material through any of the channels 20.

Referring to FIGS. 13 and 14, the raised edge 18 is formed around a rear end and the sides of the template 14. The raised edge 18 is configured to provide a handle for an operator to manipulate the template 14. For instance, the raised edge 18 includes ledges 66 (shown in FIG. 13) at each side of the template 14 for lifting the template 14. The raised edge 18 also includes a ledge 68 at a rear edge of the template 14. The ledges 66 and 68 may be one continuous ledge formed at the top of the raised edge 18.

The construction and arrangement of the elements of the apparatus as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

It should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A cutting device, comprising:

a base defining a longitudinal axis extending therethrough, the base, when in an upright position, comprising:

a bottom surface; and one or more projections extending from the bottom surface and configured to interact with a channel;

a handle engaging the base, the handle disposed annularly about the longitudinal axis and configured to move relative to the base in a first movement and a second movement different from the first movement, wherein the first movement is in a direction axially along the longitudinal axis between a first position and a second position; and a blade cartridge engaging the handle and the base, the blade cartridge comprising a rotary blade moveable between a retracted position when the handle is in the first position and an extended position when the handle is in the second position, wherein in the retracted position, the blade is disposed above the bottom surface of the base, and wherein in the extended position, at least a portion of the blade is disposed below the bottom surface of the base and in line with the one or more projections.

2. The cutting device of claim 1, wherein in the second movement, the handle is freely rotatable annularly about the longitudinal axis, relative to the base.

3. The cutting device of claim 1, further comprising a biasing member positioned between the blade cartridge and the base, the biasing member biasing the handle in the first position, and wherein the handle is moveable to the second position in response to a force applied to the handle in the direction along the longitudinal axis.

4. The cutting device of claim 3, wherein the biasing member is a spring, the spring biasing the rotary blade to the retracted position.

5. The cutting device of claim 1, wherein the one or more projections include two projections, and wherein the blade extends between the two projections when the rotary blade is in the extended position.

6. The cutting device of claim 1, wherein the one or more projections include chamfers.

7. The cutting device of claim 1, wherein the rotary blade is configured to cut a circular pattern having a predetermined radius when the cutting device is tracked along a channel having a semi-circular shape having a predetermined radius while both the handle is in the second position and the one or more projections are positioned within the channel.

8. The cutting device of claim 1, wherein the rotary blade extends a further distance from the bottom surface than the one or more projections when the handle is in the second position.

9. The cutting device of claim 1, wherein the handle comprises a body and a cap removably coupled to the body, and wherein the cap is removable so as to provide access to the blade cartridge where the body and the cap define the engagement with the blade cartridge and the body defines the engagement with the base.

10. The cutting device of claim 9, wherein the blade cartridge further comprises a tab that is graspable by a user of the cutting device to remove the blade cartridge from the cutting device, and wherein the tab is accessible when the cap is de-coupled from the body.

11. The cutting device of claim 10, wherein the cap comprises a pocket that is sized and shaped to accommodate the tab, and wherein the cap further comprises a projection within the pocket that engages the tab when the handle is moved to the second position, causing the rotary blade to extend from the base.

12. The cutting device of claim 1, wherein the blade cartridge further comprises a housing and a flange extending from the housing and defining the engagement with the handle; and wherein the rotary blade is coupled to the housing.

13. The cutting device of claim 1, wherein the handle further comprises an annular body and an opening extending axially through the body, the opening receiving at least a portion of the base and the blade cartridge therein.

14. A system, comprising:

a template comprising a channel having a predetermined shape; and a cutting device, including:

a base defining a longitudinal axis extending therethrough, the base, when in an upright position, comprising:

a bottom surface; and one or more projections extending from the bottom surface and configured to interact with the channel;

a handle engaging the base, the handle configured to rotate relative to the base about the longitudinal axis; wherein the handle is moveable relative to the base axially along the longitudinal axis, between a first position and a second position, and a removable blade cartridge engaging the handle and the base, the blade cartridge including a rotary blade moveable with the blade cartridge between a retracted position when the handle is in the first position and an extended position when the handle is in the second position, wherein in the retracted position, the blade is disposed above the bottom surface of the base, and wherein in the extended position, at least a portion of the blade is disposed below the bottom surface of the base and in line with the one or more projections, and wherein the rotary blade is configured to cut a pattern according to the predetermined shape when the cutting device is tracked along the channel while both the handle is in the second position and the one or more projections are positioned within the channel.

15. The system of claim 14, wherein the blade cartridge includes a guide received in a corresponding feature formed in the base, aligning the removable blade cartridge with the base such that the rotary blade cuts in a direction that is tangential to the pattern.

16. The system of claim 14, wherein the cutting device further comprises a biasing member positioned between the blade cartridge and the base, the biasing member biasing the blade cartridge in the retracted position and wherein the blade cartridge is moveable to the extended position in response to a force applied to the handle in a direction along the longitudinal axis.

17. The system of claim 14, wherein the blade cartridge further comprises a flange defining the engagement with the handle.

18. The system of claim 14, wherein the template comprises:

a bottom surface; and a stop coupled to the bottom surface, the stop raised relative to the bottom surface and configured to align a sheet of material to be cut.

19. The system of claim 18, wherein the stop includes a plurality of strips having the channel positioned in between.

20. The system of claim 18, wherein the stop is positioned across a diameter of the channel, such that a portion of the channel on one side of the stop has a semi-circular shape.

21. The system of claim 18, wherein the template further comprises a top surface opposite the bottom surface, and a raised outer edge bordering rear and side portions of the top surface.

22. The system of claim 21, wherein the raised outer edge includes an upper ledge providing a lift point for the template.

* * * * *